US007540049B2

(12) United States Patent
Sklenarik et al.

(10) Patent No.: US 7,540,049 B2
(45) Date of Patent: Jun. 2, 2009

(54) SUPPORT PILLOW FOR BREASTFEEDING

(76) Inventors: Deborah Sklenarik, 16839 Banding Creek La., Friendswood, TX (US) 77646; Melissa Gagliano, 2513 Massey Tompkins Rd., Baytown, TX (US) 77521

( * ) Notice: Subject to any disclaimer, the term of this patent is extended or adjusted under 35 U.S.C. 154(b) by 0 days.

(21) Appl. No.: 11/873,161

(22) Filed: Oct. 16, 2007

(65) Prior Publication Data

US 2009/0094752 A1 Apr. 16, 2009

(51) Int. Cl.
*A47C 20/00* (2006.01)

(52) U.S. Cl. ..... 5/630; 5/652; 5/655

(58) Field of Classification Search ..... 5/655, 5/630, 652, 735, 640, 491, 636, 639, 643, 5/645–647, 740
See application file for complete search history.

(56) References Cited

U.S. PATENT DOCUMENTS

| | | | | |
|---|---|---|---|---|
| 2,041,066 | A | 5/1936 | Howard | |
| 2,336,707 | A | 12/1943 | Thompson | |
| 2,427,851 | A | 9/1947 | Gerst | |
| 2,522,120 | A | 9/1950 | Kaskey et al. | |
| 3,967,335 | A * | 7/1976 | Rhoads | 5/632 |
| 4,731,890 | A | 3/1988 | Roberts | |
| 4,816,004 | A | 3/1989 | Emanuel | |
| 5,029,351 | A | 7/1991 | Weber | |
| 5,109,557 | A | 5/1992 | Koy et al. | |
| 5,133,098 | A | 7/1992 | Weber | |
| 5,154,649 | A | 10/1992 | Pender | |
| 5,239,717 | A | 8/1993 | Sue | |
| 5,261,134 | A | 11/1993 | Matthews | |
| 5,519,906 | A | 5/1996 | Fanto-Chan | |
| 5,546,620 | A | 8/1996 | Matthews | |
| 5,661,861 | A | 9/1997 | Matthews | |
| 5,718,010 | A * | 2/1998 | Beier | 5/636 |
| 5,790,999 | A | 8/1998 | Clark | |
| 6,237,599 | B1 | 5/2001 | Maulding | |
| 6,381,786 | B1 | 5/2002 | Cadden | |
| 6,502,262 | B1 | 1/2003 | Piscopo | |
| 6,651,282 | B1 | 11/2003 | Skoug et al. | |
| 6,711,770 | B1 | 3/2004 | Owens et al. | |
| 7,059,935 | B1 | 6/2006 | Jamshidi | |
| 7,111,347 | B1 | 9/2006 | Cottrell | |
| 7,426,762 | B2 * | 9/2008 | Dazzi | 5/632 |
| 2001/0044968 | A1 | 11/2001 | Schmitter et al. | |
| 2002/0146673 | A1 | 10/2002 | Aranas | |
| 2007/0094799 | A1 | 5/2007 | Wilson | |

* cited by examiner

*Primary Examiner*—Michael Trettel
(74) *Attorney, Agent, or Firm*—John Karl Buche; Buche & Associates, P.C.

(57) ABSTRACT

Disclosed is a substantially c-shaped pillow that offers support to a woman's breast, particularly during breastfeeding. The breast pillow wraps around the breast offering support to the entire breast and assisting in proper placement of the breast during breastfeeding, freeing the woman from having to use her hand to hold her breast in place.

1 Claim, 4 Drawing Sheets

SUPPORT PILLOW FOR BREASTFEEDING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present invention relates to the process of breastfeeding. Specifically, it is a pillow designed to provide full support to the breast itself, making the breastfeeding process more comfortable for mother and child.

2. Background of the Invention

The many benefits of breast-feeding children are well known. Breast-milk contains antibodies that protect the young child from illness including painful ear infections, upper and lower respiratory ailments, allergies, intestinal disorders, colds, viruses, staph, strep and *e. coli* infections, diabetes, juvenile rheumatoid arthritis, many childhood cancers, meningitis, pneumonia, urinary tract infections, salmonella, Sudden Infant Death Syndrome (SIDS) as well as lifetime protection from Crohn's Disease, ulcerative colitis, some lymphomas, insulin dependent diabetes, and for girls, breast and ovarian cancer. Breastfed babies tend to be less susceptible to dental caries. Breastfeeding helps the mother lose her pregnancy weight. Economically, breast-milk is much less expensive than the alternatives. Breast-milk does not have to be mixed, measured, heated, and/or cooled the way formula or milk does, and there is no bottle to be cleaned after feeding. The act of breastfeeding builds a strong bond between the mother and child.

As natural as breastfeeding is, it is not always instinctive or comfortable and often a lactation consultant must be employed to teach the mother how to breastfeed her child. The most common method of breastfeeding taught today is the "cradle hold," where the baby is held by one bent arm and the other hand is used to position the breast. The mother must position the baby so that it can "latch" to her breast and hold the correct position until the baby is done feeding. The weight of the baby on the support arm can become very burdensome and cannot be relieved by the other hand because it is occupied keeping the breast in place. Improper positioning can result in the baby not being able to get any milk and can even do damage to breast tissue.

A number of attempts to ease the breastfeeding process have been made. One of the most widely recognized is the pillow sold by The Boppy® Company, disclosed in U.S. Pat. No. 5,261,134 (1993). This pillow rests on and around the mother's lap and helps by supporting the weight of the child during breastfeeding. The size of the pillow makes it inconvenient to lug around so it can only be used in a limited area and if the mother is seated. Also, the woman may still have to manually hold her breast in position so that the child may latch. This occupies one of her hands for the duration of the feeding. Devices designed to free the woman's hand by offering support to the breast itself rather than the child during breastfeeding include those disclosed in U.S. Pat. Nos. 7,059,935 to Jamshidi (2006), 6,502,262 to Piscopo (2003), and 6,237,599 to Maulding (2001), as well as application Ser. Nos. 09/824,600 by Schmitter et al. (2001) and 09/824,914 by Aranas (2002). While these inventions are smaller than the large lap pillow and have the benefit of being portable, they are often too small to offer adequate support to the breast. These devices give support only at the bottom of the breast and do not extend to the sides or top of the breast. It is difficult to keep these devices in place while the child is breastfeeding.

SUMMARY OF THE INVENTION

Accordingly, it is an objective of the present application to provide a cushion that will fully support a woman's breast holding it in proper breastfeeding position rather than the woman having to hold her breast in place. The cushion is substantially shaped like the letter "C".

It is a further objective of the application to provide a means to simplify the breastfeeding process and make it more comfortable to mother and child.

It is an objective of the present invention to provide a breast pillow that is portable, cost-effective to manufacture, and of sturdy construction.

It is an objective of the present invention to provide a device that will assist in maintaining proper positioning while breastfeeding.

It is an objective of the present invention to provide a method of supporting a breast while a child is breastfeeding.

It is an objective of the present invention to recognize that women have different sized breasts and to accommodate a variety of breast sizes.

Other objectives of the invention will become apparent to those skilled in the art once the invention has been shown and described.

BRIEF DESCRIPTION OF THE DRAWING

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
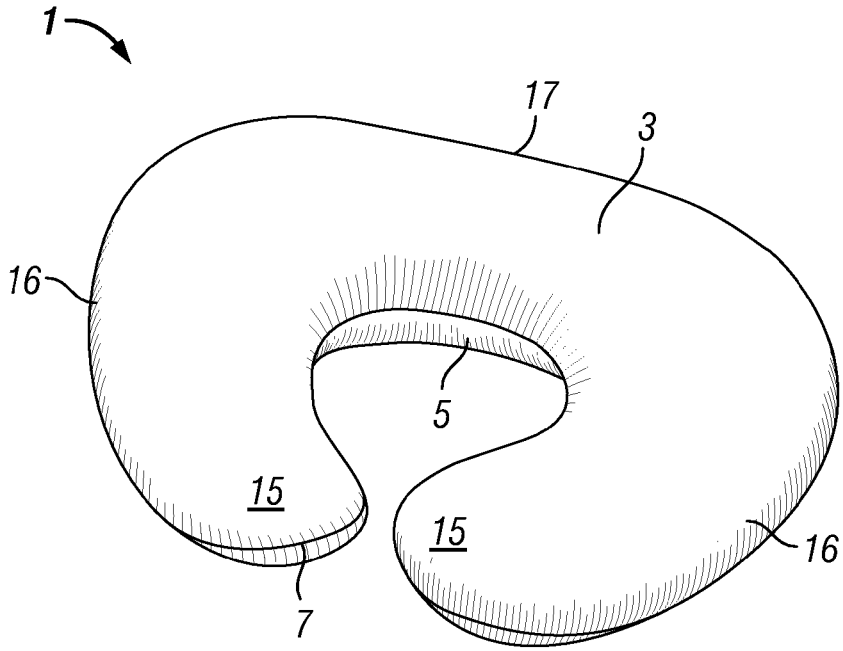
FIG. 1 is a perspective view of the breast pillow.

FIG. 1 is a perspective view of the breast pillow 1. The breast pillow 1 is composed of a top surface 3 and a bottom surface 5 connected at the seam 7 (see FIG. 4), enclosing a filling 6. The top surface 3 and bottom surface 5 will be a type of fabric such as cotton, silk, velvet, fleece, terry cloth, or other such durable material. Although they are often the same material, the top surface 3 and bottom surface 5 may be made of different materials, for example, a breast pillow 1 could have a terry cloth top surface 3 and a cotton bottom surface 5. The top surface 3 and bottom surface 5 are connected with thread or the other closing means, such as buttons, Velcro®, snaps, zippers, etc., to form the seam 7. An appropriate filling 6, such as cotton, down, poly fiberfill, micro-beads, cotton, or other synthetic or natural fillers, will be enclosed between the top surface 3 and bottom surface 5 to provide the supportive substance. Variations will be appreciated by those skilled in the art. The breast pillow 1 is substantially C-shaped, the longest part of which is the base 17. The breast pillow 1 then curves to form the sides 16 which continue to curve toward each other to form the tips 15. The tips 15 extend from each of the sides 16 and approach one another, almost touching to form a circle, but leave an opening 2 (see FIG. 3). The area between the base 17, sides 16, tips 15, and opening 2 (see FIG. 3), is the center space 4. The breast pillow 1 can be a variety of sizes to accommodate the different sizes of women's breasts. Although other sizes are possible, typically, a breast pillow 1 has an exterior width b (FIG. 4) ranging from about 4 to 12 inches and a center space 4 (FIG. 3) ranging between about 1.5 to 5 inches. As a further example, one preferred embodiment that could accommodate a C-DD cup size has an exterior width b of about 8 to 14 inches and a center space 4 (FIG. 4) of approximately 2 to 7 inches. The center space 4 (FIG. 4) should be slightly smaller in diameter than the woman's breast to ensure a supportive fit.

Figure 2:
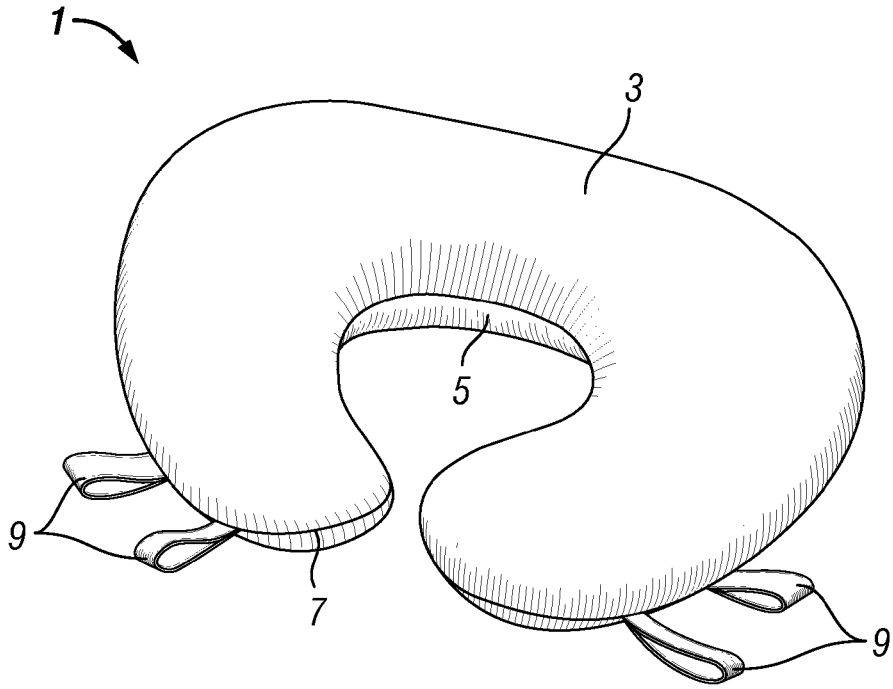
FIG. 2 is a perspective view of the breast pillow with optional loops.

FIG. 2 is a perspective view of the breast pillow 1 with optional loops 9. The loops 9 can be made of silk or grosgrain ribbon or other such suitable material. In the preferred embodiment, the loops 9 are attached at the seam 7, located at the outer edge of the tips 15, but can be positioned anywhere on the breast pillow 1. In the preferred embodiment, four loops 9 are shown, but it is to be understood that any number of loops 9 can be attached as desired. The loops 9 are shown here to be attached at the seam 7 (see FIG. 4), but that is not meant to be limiting, as the loops 9 can be attached anywhere on the breast pillow 1 by the designer. The loops 9 are not only decorative but are also an attractive engagement for the child during feedings. As they are not required to use their hands to feed themselves, breastfeeding children have a tendency to grasp onto whatever is within reach. This sometimes has an irritating or painful result if they happen to scratch their mother's skin, pull her hair, or tug on her jewelry. Other things are also at risk, if the mother is not careful, a child could grab the cord of a lamp and pull if off of a table. The loops 9 provide a safe occupation for the feeding child's hands.

Figure 3:
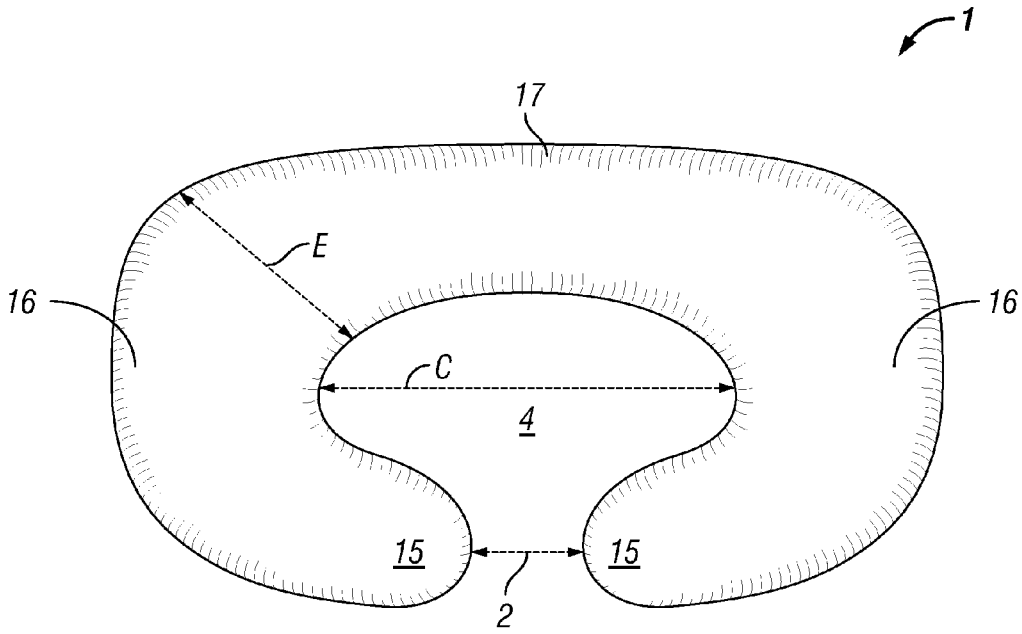
FIG. 3 is a top perspective of the breast pillow.

FIG. 3 is a top view of the breast pillow 1. The pillow width e is measured across the top surface 3 and is determined by the size of the breast pillow 1. The pillow width e can range anywhere from about 0 to 6 inches. The center space 4 is measured from the inner edges of the sides 16 (FIG. 3) facing each other. The size of the center space 4, which can range from 1.5 to 6 inches, is also determined by the size of the breast pillow 1. The opening 2 (see FIG. 3), which usually measures 4 inches or less, is also seen in this drawing.

Figure 4:
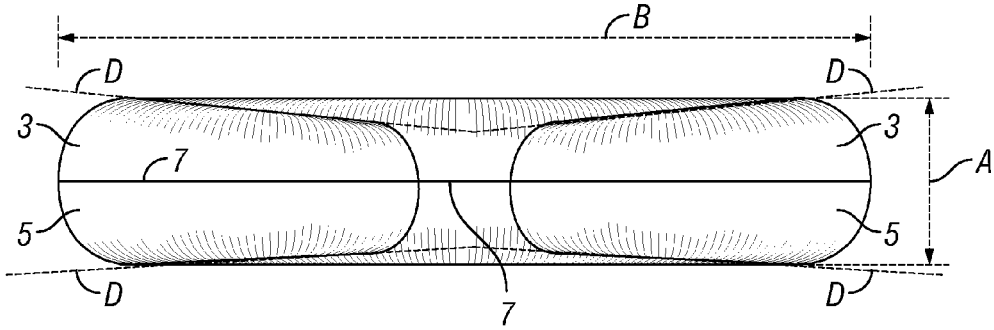
FIG. 4 is a side perspective of the breast pillow.

FIG. 4 is a side view of the breast pillow 1. The exterior width b of the breast pillow 1 is measured from the outer ends of the sides 16. The pillow height a is measured at the center of the base 17 (FIG. 3) from the uppermost part of the top surface 3 to the lowermost part of the bottom surface 5. The seam 7 that connects the top surface 3 and bottom surface 5 can be seen around the middle of the breast pillow 1. It is also apparent in this drawing that the top surface 3 and bottom surface 5 of the tips 15 (FIG. 3) may taper at an angle d as they approach the opening 2 (see FIG. 3), and seam 7. Using the seam 7 as the x-axis, the top surface 3 may angle upward at an angle ranging from about 30° to about 80°. Likewise, the bottom surface 5 may slope downward from the seam 7 at an angle anywhere from approximately −30° to −80°.

Figure 5:
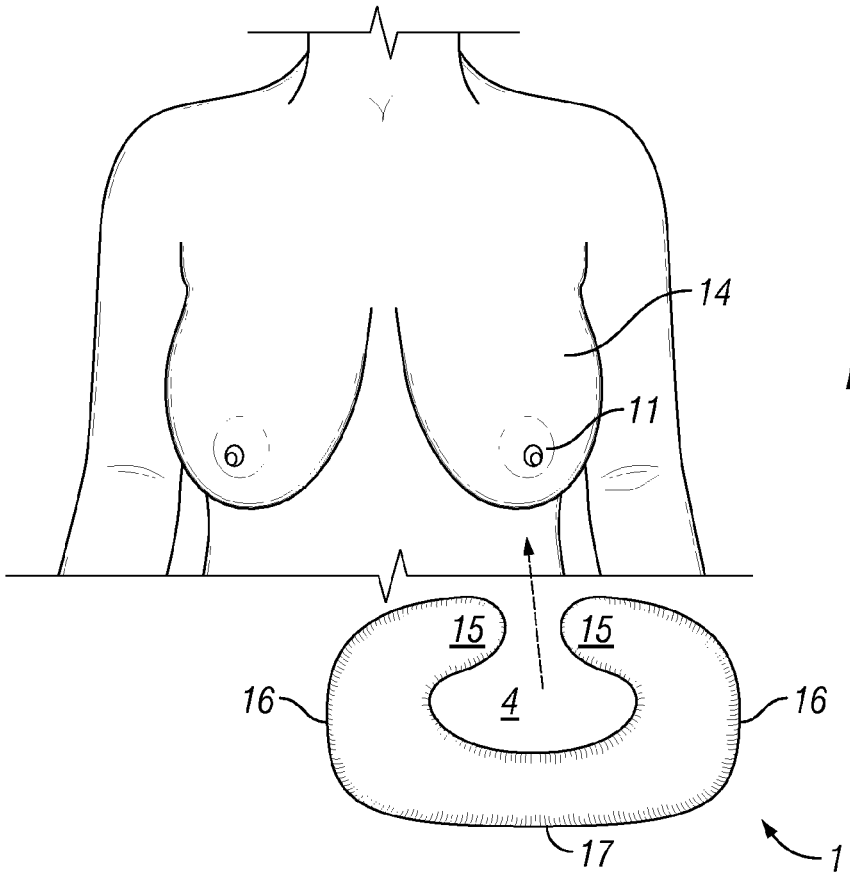
FIG. 5 is a front perspective of the woman's chest without the support of the breast pillow.

FIG. 5 is a front view of a woman's chest without the support of the breast pillow 1. In use, the bottom surface 5 (FIGS. 1, 2) of the breast pillow 1 is placed against the skin with the base 17 underneath the breast 14 and the sides 16 wrapping upwards so that the breast 14 rests in the center space 4. The tips 15 and opening 2 (FIG. 7) are at the top of the breast 14. The breast 14 is completely encircled by the breast pillow 1, except for the small opening 2 (FIG. 7).

Figure 6:
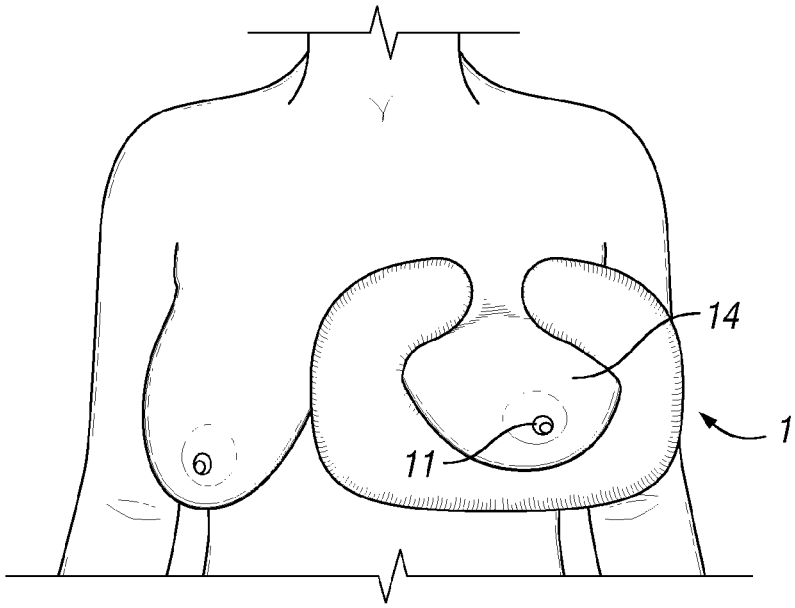
FIG. 6 is a front perspective of the woman's chest with the breast pillow supporting the breast.

FIG. 6 is a front view of a woman's chest with the breast pillow 1 supporting the breast 14. Once the breast 14 is placed in the center space 4 with the support of the base 17 (FIG. 3), sides 16 (FIG. 3), and tips 15 (FIG. 3), the areola 11 is exposed in a way that makes it easier for the child to latch for feeding. The child's head can rest on the breast pillow 1 that is supporting the breast 14, and the woman now has both hands free to hold her child 13 (FIG. 7) or do other tasks.

Figure 7:
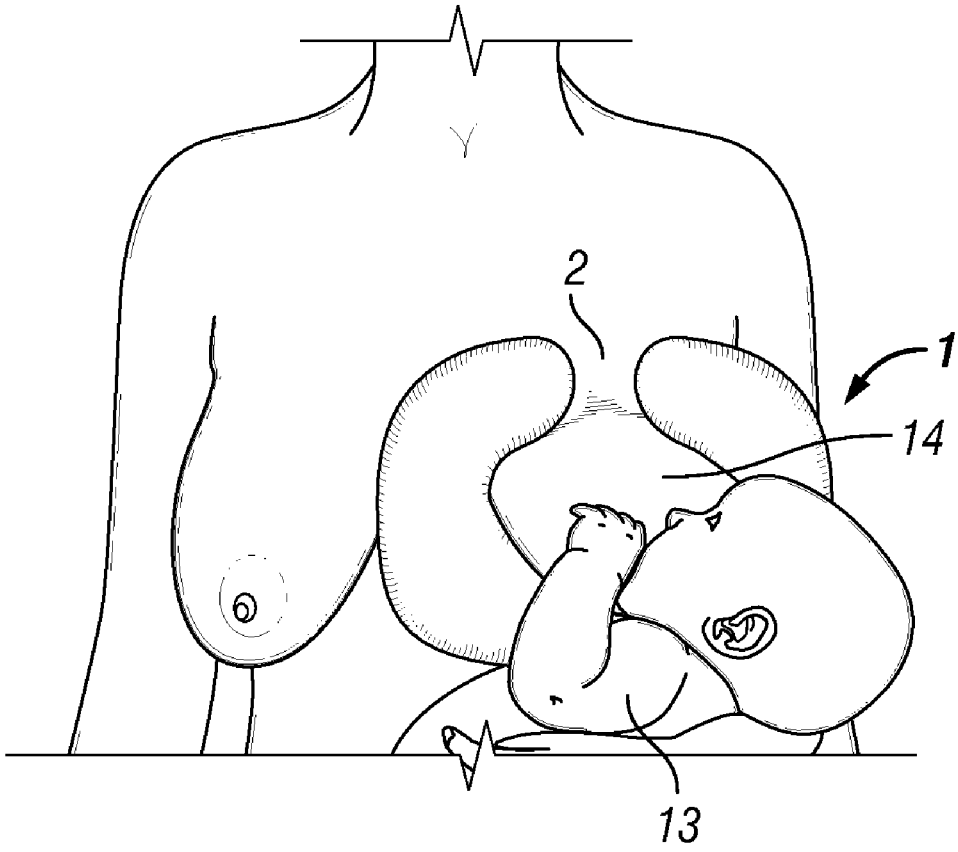
FIG. 7 is a front perspective of the woman's chest with the breast pillow supporting the breast and the child latched to the breast.

FIG. 7 is a front view of a woman using the breast pillow 1 while feeding a child 13. The breast pillow 1 is secured around the breast 14, holding it in proper position for the child 13 to latch and feed. The bottom surface 5 (FIGS. 1, 2) is touching the woman's chest and the child 13 rests on the top surface 3 (FIGS. 1, 2). If the child 13 moves the breast pillow 1 while feeding, the woman can easily readjust it using her free hand.

The appended drawings illustrate only typical embodiments of this invention and are therefore not to be considered limiting of its scope, for the invention may admit to other equally effective embodiments which are appreciated by those skillful in the arts.

We claim:

1. A method of breastfeeding a child using a breast feeding pillow featuring a top surface, a bottom surface, a seam that connects the top surface and bottom surface, a filling material, a base, sides, tips which approach each other but leave an opening, and a center space, said method comprising the steps of:

positioning said breast pillow so that the breast is in the said center space with said bottom surface against the mother's skin;

securing said base of said pillow underneath said breast and wrapping said sides around said breast so that said tips are at the top of said breast;

lifting the child to said breast which is held in place by said pillow.

* * * * *